US005988030A

United States Patent [19]

Hada et al.

[11] Patent Number: 5,988,030

[45] Date of Patent: Nov. 23, 1999

[54] APPARATUS FOR PENETRATING A SHEET MATERIAL WEB CARRIED ON A FABRIC

[75] Inventors: Frank S. Hada; Lowell E. Thoms, both of Appleton, Wis.

[73] Assignee: Kimberly-Clark Worldwide, Inc., Neenah, Wis.

[21] Appl. No.: 08/933,654

[22] Filed: Sep. 19, 1997

[51] Int. Cl.[6] ..... B26D 7/14

[52] U.S. Cl. ..... 83/176; 83/402; 83/471; 83/477; 493/25

[58] Field of Search ..... 83/176, 402, 425, 83/438, 471, 477, 444; 493/25

[56] References Cited

U.S. PATENT DOCUMENTS

| | | | |
|---|---|---|---|
| 3,880,047 | 4/1975 | Dosier | 90/12 D |
| 3,976,237 | 8/1976 | Bossons | 226/97 |
| 4,090,425 | 5/1978 | Platt | 83/402 |
| 4,403,533 | 9/1983 | Cox et al. | 83/56 |
| 4,523,500 | 6/1985 | Maruyama | 83/37 |
| 4,542,842 | 9/1985 | Reba | 225/2 |
| 5,031,494 | 7/1991 | Asselborn et al. | 83/100 |
| 5,036,737 | 8/1991 | Glaser | 83/100 |
| 5,406,869 | 4/1995 | Prochnow et al. | 83/22 |
| 5,591,309 | 1/1997 | Rugowski et al. | 162/283 |
| 5,593,545 | 1/1997 | Rugowski et al. | 162/207 |
| 5,794,500 | 8/1998 | Long et al. | 83/22 |

OTHER PUBLICATIONS

Laser Analog Displacement Sensor LAS–5010 LAS–8010, Technical Manual, cover page and p. 7.

*Primary Examiner*—M. Rachuba
*Attorney, Agent, or Firm*—Brinks Hofer Gilson & Leone

[57] ABSTRACT

An apparatus for penetrating a sheet material web being carried on a fabric. The apparatus including a penetrating device and an air flow that separates a portion of the sheet material web from the fabric adjacent the penetrating device so as to bring the web into contact with the penetrating device. In one embodiment, a vacuum lifts a portion of the sheet material web into contact with a slitting member such that it continuously slits the sheet material web longitudinally along its length as the fabric carries the sheet material web beneath it. In an alternative embodiment, a pressurized air stream is directed to a bottom portion of the sheet material web so as to separate the web from the fabric. A method for penetrating a sheet material web as it is carried on a fabric includes the steps of carrying the sheet material web on a fabric in a longitudinal direction, applying an air flow to the web so as to separate a portion of the web from the fabric, penetrating the web as it is separated from the fabric and reapplying the sheet material web to the fabric.

37 Claims, 6 Drawing Sheets

APPARATUS FOR PENETRATING A SHEET MATERIAL WEB CARRIED ON A FABRIC

BACKGROUND OF THE INVENTION

The present invention relates generally to a method and apparatus for penetrating a sheet material web, and in particular, to a method and apparatus for penetrating a sheet material web, such as by slitting, cutting, puncturing or perforating, while the web is being carried on a fabric.

It is well known in the field of paper making, and particularly in the field of manufacturing tissue products such as facial tissues, bath tissues and paper towels, to provide an apparatus for longitudinally slitting a continuous running sheet material web into two or more strips. Typically, the sheet material web is slit either as it traverses an "open draw" before being wound into rolls, before it is dried or after it is wound onto the roll. In the first instance, the area of open draw, where the dried sheet is momentarily unsupported before being wound, provides an ideal place to slit the web. In particular, the slitting device, often configured as a rotary saw blade, can be applied to the web without concern about cutting or otherwise damaging an underlying fabric, which otherwise carries the sheet material web throughout the forming process. Fabrics of this nature can be expensive and difficult to replace.

However, as described in U.S. Pat. No. 5,591,309, issued Jan. 7, 1997 to Rugowski et al., and assigned to Kimberly-Clark Corporation, the same assignee as the present application, open draws are a frequent source of sheet breaks and associated production delays. As a result, tissue sheets often are designed to have high machine direction strengths in order to remain intact as they are pulled through the open draw. However, high machine direction strengths can adversely affect the quality of the web in terms of its desired softness. Therefore, as explained in U.S. Pat. No. 5,591,309, the elimination of open draws in tissue manufacturing can result in a sheet material being made more efficiently at less cost and with more desirable properties.

When the open draw is eliminated, the sheet material web is typically slit using a water jet prior to drying the web. However, such "wet slitting" can result in a degradation of the throughdrying fabric as it is exposed to hot air passing through the slit in the sheet material during the drying stage of the process. Moreover, the slit edges of the sheet material web may not dry evenly due to the pile up of fibers along the slit. Additionally, when the sheet material web is slit prior to drying, the various strips of sheet material web are difficult to control and can become inadvertently interwoven, or overlapped, as they are further carried towards the wind-up reel. Interwoven strips can be more easily damaged and can make the winding process particularly difficult. Moreover, adjacent rolls having interwoven webs can be particularly difficult to separate. Accordingly, the strips of sheet material web are typically required to be spread apart so as to prevent interweaving.

In contrast to slitting the web prior to drying, it is also known in the art to slit the sheet material web as it is wound onto the roll, as mentioned above. Slitting apparatuses of this nature typically apply a pressure or guide roller, or like device, to the outermost surface of the roll so as to thereby control the penetration of the slitting device. However, facial and bath tissues typically have low densities. Accordingly, it usually is not desirable, or even possible, to allow such a guide roller to contact the roll as it builds so as to thereby control the position of the slitter, and the penetration thereof. Moreover, the various strips are necessarily wound onto the same roll and must be rewound onto separate rolls after slitting in another manufacturing step if desired.

Alternatively, the sheet material web can be carried on two or more belts aligned side-by-side, wherein a slitting blade protrudes through the gap between the belts. The sheet material web can become caught or torn in the gap, however, and it is not possible to change the lateral position of the slitting device without reconfiguring the belts, which can be very expensive and time consuming. Moreover, the control of the belts, and the alignment thereof, can be difficult to maintain.

SUMMARY OF THE INVENTION

Briefly stated, the invention is directed to an apparatus for penetrating a sheet material web, such as by slitting, cutting, puncturing or perforating, while being carried on a fabric. In a preferred embodiment, the apparatus includes a penetrating device positioned above the fabric and an air flow, which is applied to a portion of the sheet material web adjacent the penetrating device so as to separate the web from the fabric and thereby bring the web into contact with the penetrating device above the fabric.

In a preferred embodiment, the apparatus includes a housing disposed around a slitting member, preferably configured as a rotary saw blade. The housing preferably includes a shoe member attached to a bottom of the housing and having an opening forming a mouth of the housing which opens towards the sheet material web carried on the fabric. The shoe member preferably includes a rearwardly facing nose portion shaped to strip the boundary layer of air from the sheet material web as it passes beneath the housing. Preferably, a curved plate is mounted to the shoe member at the mouth of the housing. The plate has a plurality of apertures and a slot formed therein. A vacuum is connected to the housing to apply an air flow such that a portion of the sheet material web is separated from the fabric at the mouth of the housing and thereby brought into contact with the slitting member.

In an alternative embodiment, an air hose is provided below the fabric. The air hose applies a pressurized air stream to a portion of the bottom of the web so as to lift it off of the fabric and into contact with the penetrating device, preferably including a slitting member. The air hose is used with air permeable fabrics, while the vacuum is employed with impermeable fabrics. Alternatively, the air hose can be used in combination with the vacuum so as to obtain the desired separation of the sheet material web when used with an air permeable fabric.

In one aspect of the invention, a sensor is provided below the fabric. The sensor monitors the position of the fabric and signals the retraction or stoppage of the penetrating device if the fabric inadvertently approaches the penetrating device. Preferably, the penetrating device is made height adjustable so as to allow the distance between the blade and fabric to be automatically adjusted according to the input from the sensor.

In yet another aspect, a method is provided for penetrating the sheet material web carried on the fabric. The method includes carrying the sheet material web on a fabric in a longitudinal direction, applying either a vacuum or a pressurized air stream, or both, to the sheet material web so as to separate at least a portion of the web from the fabric, penetrating the sheet material web as it is separated from the fabric and reapplying the separated portion of the sheet material web to the fabric.

The present invention provides significant advantages over other slitting or penetrating devices. Importantly, the apparatus allows for slitting the sheet material web while it is being carried by a fabric prior to winding the web onto rolls. In this way, the open draw of the forming process can be eliminated so as to reduce waste and costs, but without having to slit the sheet material web prior to the drying process, wherein the problems of fabric degradation, fiber build-up at the slit edges and loss of sheet control can be encountered. Moreover, since the apparatus can be positioned relatively close to the winding reel, as opposed to wet slitting, which is typically performed up stream in the process, the problem of interweaving can be greatly reduced.

In addition, the present invention provides an improved method and apparatus for slitting the sheet material web prior to winding the web onto rolls. In this way, the various strips of sheet material web can be directed to different wind-up reels, rather than rolling the web into a single roll, where it is then slit and rewound onto separate, individual rolls, if needed.

Moreover, since the fabric is not split, or otherwise configured to receive the slitting device, the apparatus can easily be moved laterally to any desired position above the longitudinally moving web without having to reconfigure the fabric. In addition, a plurality of slitting apparatuses can be positioned above the web so as to enable the operator to make multiple strips of sheet material web. In either situation, the desired slitting operation can be set up quickly, inexpensively and with little or no waste.

The present invention, together with further objects and advantages, will be best understood by reference to the following detailed description taken in conjunction with the accompanying drawings.

BRIEF DESCRIPTION OF THE DRAWINGS

Many of the features and dimensions portrayed in the drawings, and in particular the presentation of sheet material web thicknesses and the like, have been somewhat exaggerated for the sake of illustration and clarity.

DETAILED DESCRIPTION OF THE PRESENTLY PREFERRED EMBODIMENTS

It should be understood that the term "web," as used herein, is meant to include a sheet material made of one or more plies of material so that a multiple-ply sheet material is considered to be a "web" of sheet material, regardless of the number of plies. In addition, the term "longitudinal," as used herein, is intended to indicate the direction in which the web traverses through the forming process in the machine direction, and is not intended to be limited to a particular length of the web, whether it is cut or otherwise. Similarly, the terms "downwardly," "upwardly," "forward", "rearward", "left" and "right" as used herein are intended to indicate the direction relative to the views presented in the Figures, and in particular, from a perspective when viewing the web and fabric as they travel away from the drier toward the slitting apparatus and ultimately to the wind-up reel.

Figure 1:
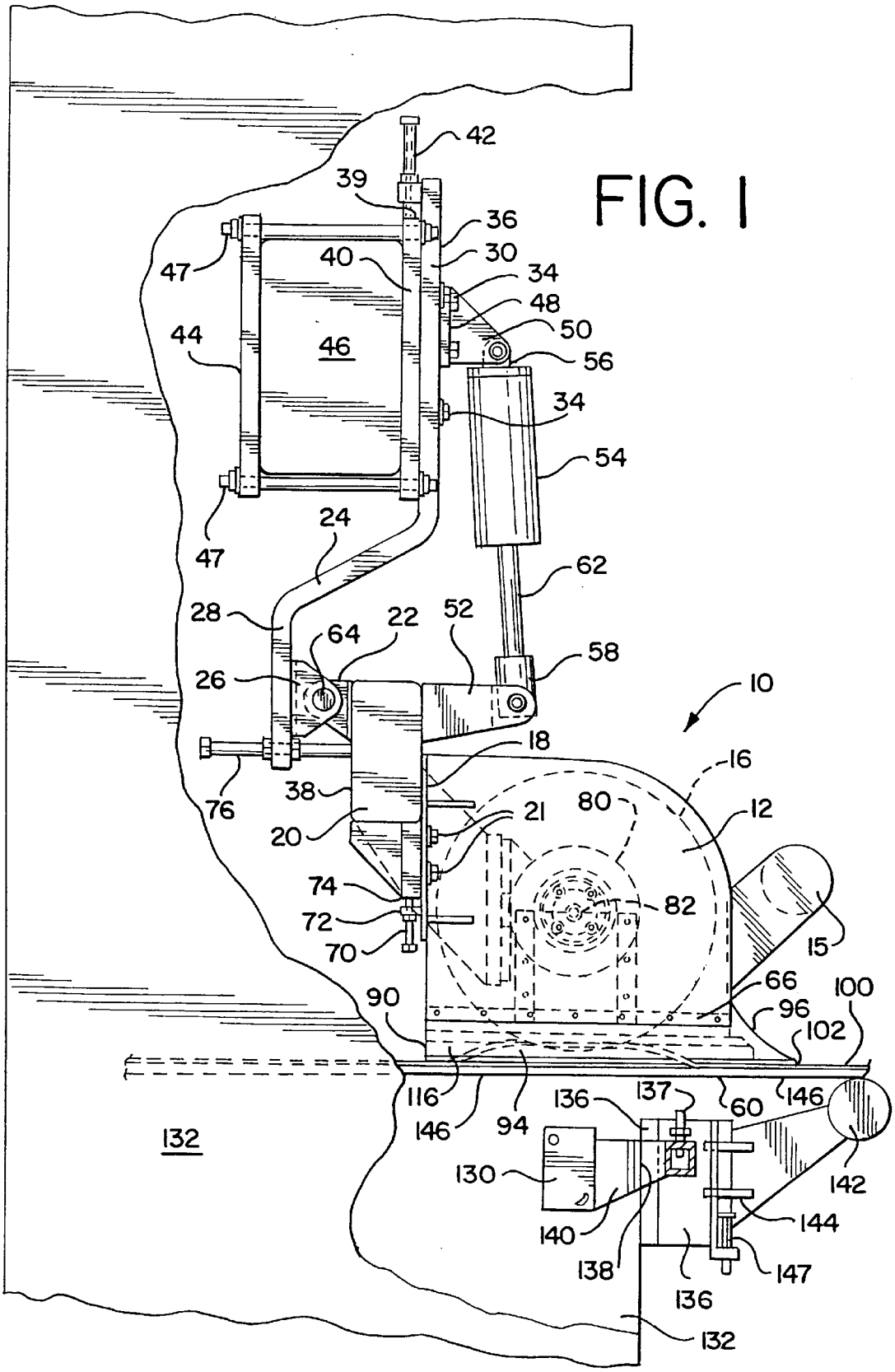
FIG. 1 is a side view of a slitting apparatus.
Figure 2:
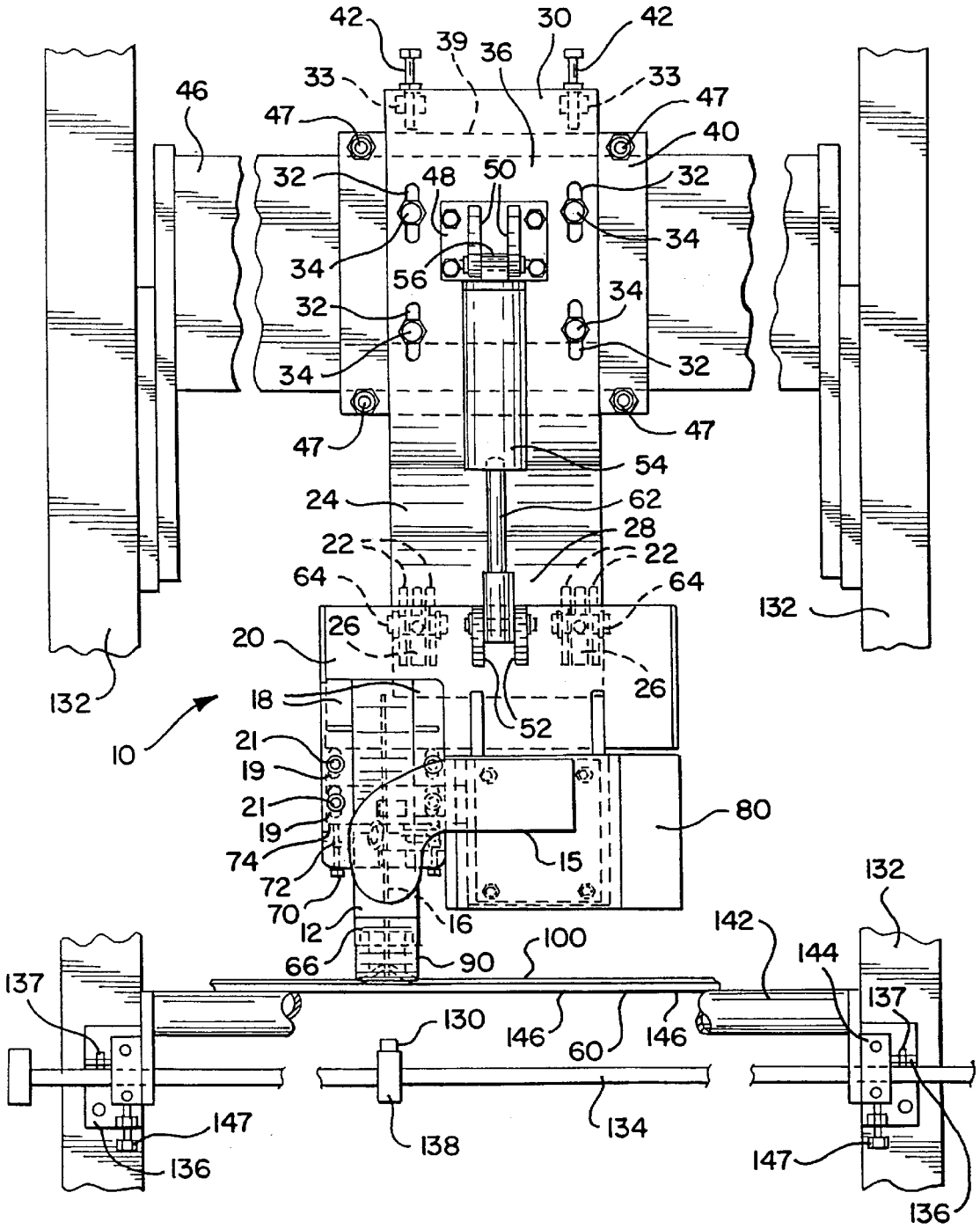
FIG. 2 is a rear view of the slitting apparatus.
Figure 3:
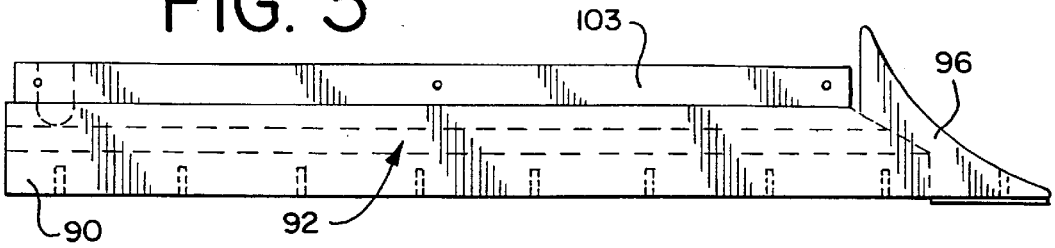
FIG. 3 is a side view of a shoe member.
Figure 4:
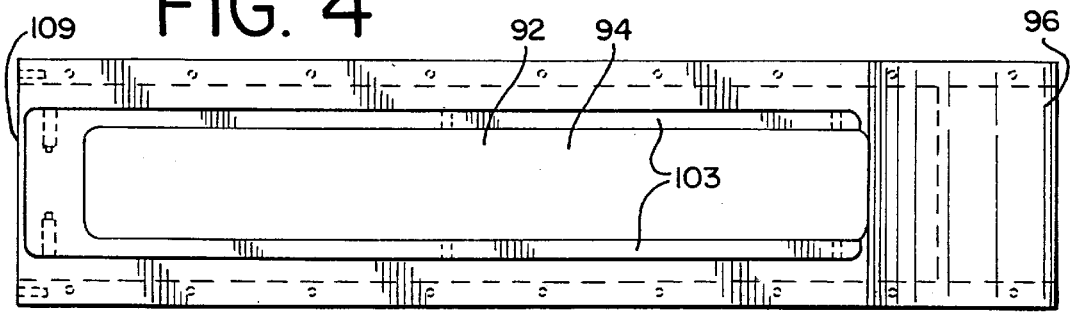
FIG. 4 is a top view of the shoe member.
Figure 5:
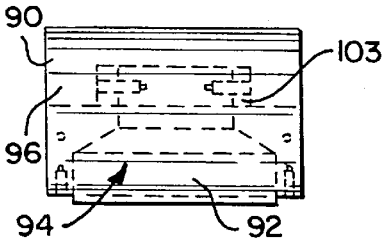
FIG. 5 is an end view of the shoe member.
Figure 8:
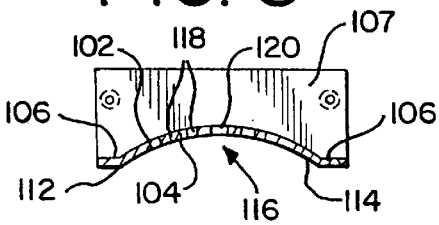
FIG. 8 is an end view of the vacuum plate.
Figure 6:
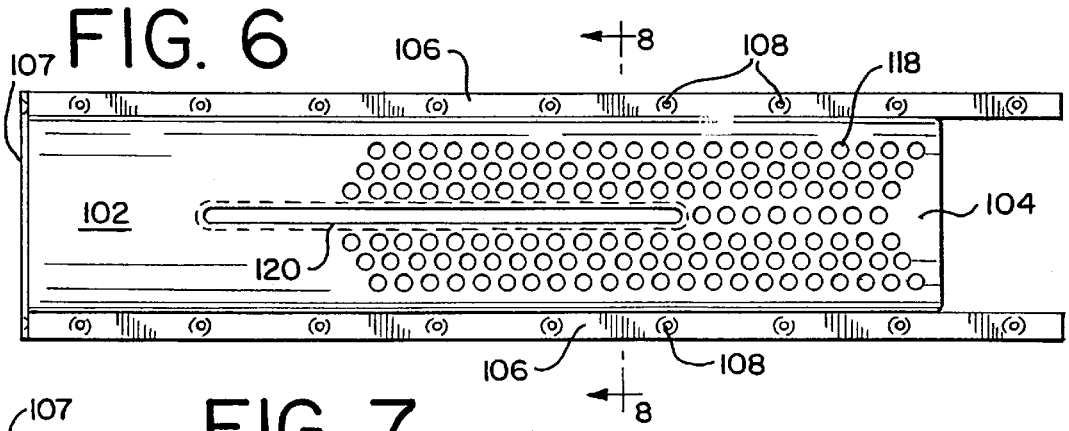
FIG. 6 is a top view of a vacuum plate.
Figure 7:
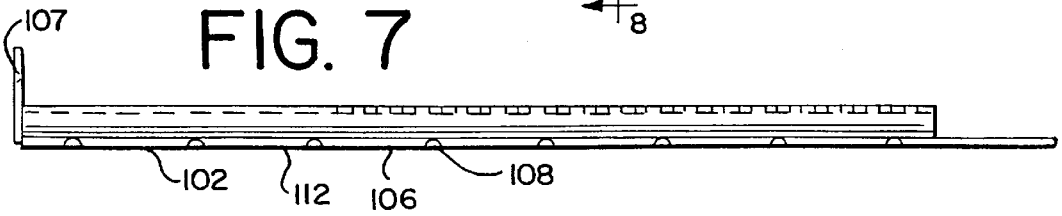
FIG. 7 is a side view of the vacuum plate.
Figure 9:
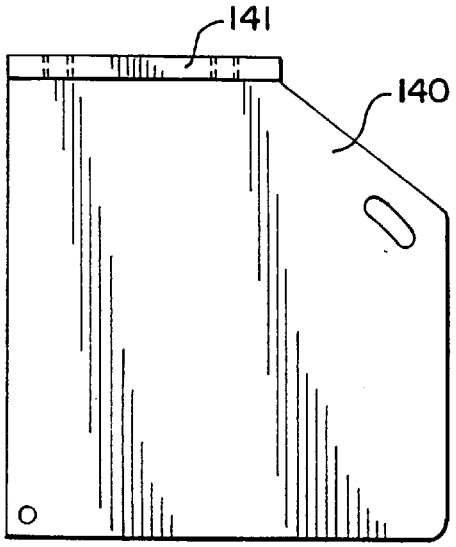
FIG. 9 is a side view of a first mounting bracket for the laser sensor.
Figure 11:
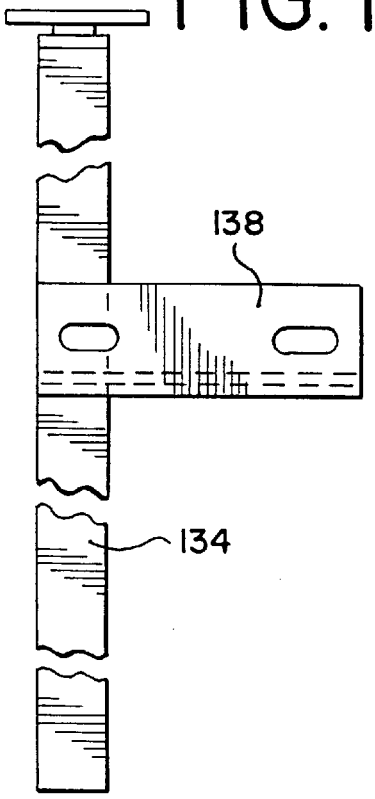
FIG. 11 is a rear view of a second mounting bracket for the laser sensor.
Figure 10:
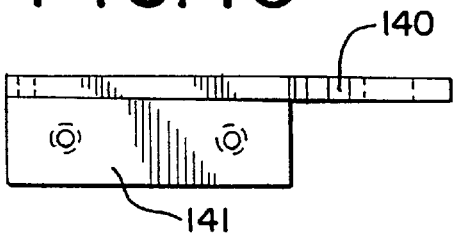
FIG. 10 is an end view of the first mounting bracket.
Figure 12:
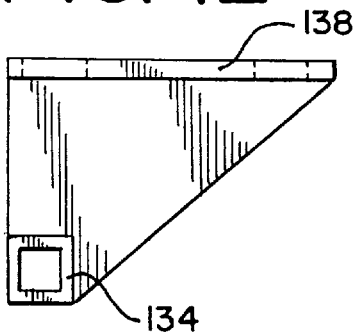
FIG. 12 is a side view of the second mounting bracket.

Referring to the drawings, FIGS. 1 and 2 show an apparatus 10 having a housing 12, a vacuum and a penetrating device, shown as a slitting member 16. A forward portion of the housing 12 includes a pair of mounting flanges 18 bolted to a pivot bracket 20 with a plurality of bolts 21. Vertically oriented slots 19 are provided in the mounting flanges 18 so as to allow the vertical position of the housing 12 to be adjusted relative to the pivot bracket 20. In addition, a pair of adjustment screws 70 extend through a pair of lug members 72 extending forwardly from the flange members 18 and engage a bottom surface 74 of the pivot bracket 20. When the bolts 21 are loosened, the adjustment screws 70 can be extended or retracted relative to the lug members 72 so as to locate the mounting flanges 18 in the desired position relative to the pivot bracket 20, wherein the bolts 21 can be tightened so as to securely mount the housing to the pivot bracket. In this way, the operator can adjust the exposure of the slitting member within a mouth 94 of the housing.

A pair of lug members 22 extend forwardly from the pivot bracket 20 at two locations and are pivotally attached with a pin 64 to a pair of rearwardly extending lug members 26 attached to a lower portion 28 of an upwardly extending plate member 24. The plate member 24 includes an upper portion 30 attached to a first mounting plate 40 with a plurality of bolts 34.

Preferably, the upper portion 30 includes a plurality of slots 32 which are adapted to receive bolts 34. A pair of lug members 33 extend forwardly from the upper portion 30. A pair of adjustment screws 42 are threadably received in the lug members 33 and engage a top surface 39 of the first mounting plate 40. In this way, the bolts 34 can be loosened so as to allow the adjustment screw 42 to be rotated and thereby raise or lower the plate member 24 to a desired height relative to the first mounting plate 40. In this way, the operator can adjust the position of the slitting member relative to the fabric 60 and control the distance therebetween. The bolts 34 are then tightened within the slots 32 to mount the plate member 24 to the first mounting plate 40.

As shown in FIG. 1, the first mounting plate 40 is attached to a second mounting plate 44 disposed on an opposite side of a laterally extending frame member 46. A plurality of bolts 47 are used to clamp the frame member 46 between the first and second plate members 40, 44. As shown in FIG. 2, the bolts 47 can be loosened so that the entire apparatus can be moved laterally along the length of the frame member 46 to a desired operating position above the longitudinally oriented fabric 60, which is preferably one-piece and spans the entire cross-machine direction of the machine. It should be understood by one of skill in the art, that the plate member, or first and/or second mounting plates, could also be fixedly attached directly to the frame member with fasteners, welding or the like.

As shown in FIGS. 1 and 2, a mounting bracket 48 is attached, with fasteners, or by welding and the like, to a rear surface 36 of the upper portion 30 of the plate member 24. The bracket 48 includes a pair of rearwardly extending lug members 50. A pneumatic cylinder 54 includes an upper end 56 which is pivotally attached to the lug members, and a shaft 62 having a lower end 58 pivotally attached to a pair of lug members 52 extending rearwardly from the pivot bracket 20. In operation, the pneumatic cylinder 54, preferably configured as a gas spring, can be extended or retracted so as to pivot the pivot bracket 20 about the axis of pin 64. Alternatively, a hydraulic cylinder can be used to actuate the pivot bracket. In addition, a pair of horizontally oriented adjustment screws 76 extend through the lower portion 28 of the plate member 24 and engage a forward surface 38 of pivot bracket 20. The adjustment screws 76 act as a stop against the pivot bracket 20 and can be extended or retracted relative to the plate member so as to limit the rotation of the pivot bracket 20, and attached housing 12 and slitting member 16, relative to the fabric 60. In this way, the slitting member is prevented from being rotated into contact with the fabric, especially in the event of a failure in the pneumatic cylinder 54.

As shown in FIGS. 1 and 2, an electric motor 80 is also attached to the pivot bracket 20. A suitable motor is the 1.1 KW, 50 Hz, 2840 RPM AC motor commercially available from ABB Industrie as Type M2JA 80L. In a preferred embodiment, the horizontally oriented shaft 82 of the motor extends laterally into the housing 12. Preferably, the slitting member 16 is a rotary saw blade. The slitting member 16 is disposed in the housing 12 and is mounted to the shaft 82 of the motor. A commercially available saw blade suitable for use is the ¾ inch inner diameter, 12 inch outer diameter tool steel blade sold by Otter-Kinetic Co. as Part No. 3074-5A. Preferably, the saw blade rotates clockwise, or in the same direction as the travel of the fabric and sheet material web, and a greater speed, preferably at about a 2:1 ratio.

Alternatively, the penetrating device can be configured as one of a stationary, fixed knife blade positioned within the housing, a water jet, a laser or any other known and conventional slitting devices. In addition, the apparatus can be used to modify the moving sheet material web as it is carried on the fabric such as by cutting the web in a transverse, cross-machine direction, by puncturing or perforating the web, or by similarly acting upon the web so as to change its size, shape or makeup. In such embodiments, one of skill in the art should recognize that the apparatus would include a penetrating device capable of making the cuts, perforations or punctures, including for example, but not limited to, rotary cutter or perforation heads.

As shown in FIGS. 1 and 2, the vacuum includes a conduit 15 attached to the rear portion of the housing. A conventional vacuum is connected to the conduit 15 so as to apply a vacuum to the housing 12. Depending on the weight of the sheet material web and the permeability of the underlying fabric, vacuum levels of from about 4 inches water column ("WC") to about 25 inches WC can be applied to the housing so as to provide an adequate separation of the sheet from the material web fabric without also drawing the fabric toward the housing.

As shown in FIGS. 1–5, the housing 12 preferably includes a shoe member 90 having flange portion 103 attached to a lower portion 66 of the housing. The shoe member 90 has a cavity 92 and a mouth 94 opening downwardly towards the underlying fabric 60 and sheet material web 100 traversing beneath it. The shoe member 90 also includes a rearwardly facing nose portion 96 which is shaped to strip the boundary layer of air from the sheet material web 100 so as to allow the web to be more easily separated from the underlying fabric. Preferably, the shoe member is made of aluminum.

Referring to FIGS. 6–9, a perforated vacuum plate member 102 is shown. Preferably the vacuum plate member 102 is curved so as to have a downwardly facing concave surface 104 overlying the sheet material web 100 and fabric 60. The concave curved surface extends substantially continuously along the longitudinal length of the plate member. A pair of mounting flanges 106 extend longitudinally along the side portions of the plate member. Each mounting flange 106 includes a plurality of holes 108. A plurality of fasteners are received in the holes and securely fasten the plate member 102 over the mouth 94 of the shoe member. In addition, an end plate 107 is attached to a forward portion 109 of the shoe member. Each of the mounting flanges 106 have a bottom surface 112. Preferably, the vacuum plate member is made of # 14 gauge stainless steel.

Figure 13:
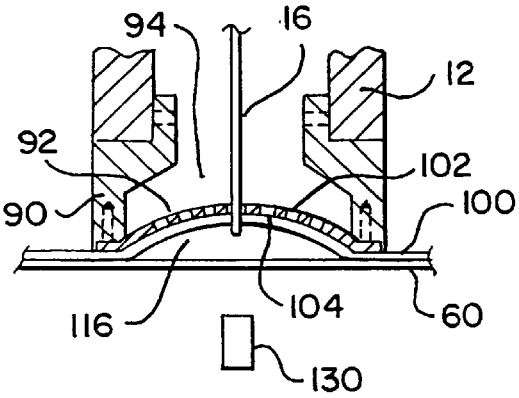
FIG. 13 is a partial enlarged cross-sectional of the slitting device engaging the sheet material web in a recess formed at the mouth of the housing.

The curved portion 114 of the plate member is received within the cavity 92 of the shoe member and forms a downwardly facing recess 116 opening towards the sheet material web as shown in FIG. 13. A plurality of apertures 118 are positioned in the curved portion 114 of the plate member. Preferably, the apertures 118 are configured as holes, rather than slots, so that the sheet material web is prevented from being drawn through the plate member and into the housing, or vacuum plenum. In addition, the plate member includes a longitudinal elongate slot 120 positioned approximately along the centerline of the plate member. The apertures 118 are positioned both on the sides of and rearwardly of the slot 120, but not forward of the slot. Preferably, the apertures do not extend the full length of the shoe member 90 so as to allow the raised portion of the sheet material web 100 to settle back onto the fabric 60 as it travels toward the wind-up reel.

As shown in FIG. 13, the shoe member 90 and vacuum plate member 102 allow the relatively more flexible sheet material web 100 to be drawn into the recess 116 and into contact with the slitting member 16, but prevent the relatively inflexible fabric 60, which is stretched tight over reel drum 174, from being drawn into the recess as it contacts the bottom of the shoe member and/or plate member flanges. In this way, the shoe member 90 and vacuum plate member 102 prevent the slitting member from contacting and thereby damaging the fabric 60. In addition, screw 70 can be adjusted to expose more or less of the slitting member 16 within the recess 116.

In addition, as shown in FIGS. 1–2 and 9–12, a laser displacement sensor 130 is mounted to a frame member 132 below the fabric 60. In particular, a cross member 134 is adjustably mounted to a bracket 136 attached to the vertical frame member 132. The cross member 134 includes flange member 138 at about a midpoint of the cross member. The laser sensor 130 is mounted on a bracket member 140 which includes a flange member 141 attached to flange member 138. In operation, the cross member 134 can be moved laterally beneath the fabric 60 by sliding the cross member between the support brackets 136 mounted on opposite sides of the machine as the apparatus 10 is moved laterally above the fabric 60 such that the laser sensor 130 is directed at the fabric immediately below the slitting member, preferably at the approximate centerline of the rotary saw blade at its lowest point adjacent the fabric. A lock-down bolt 137 is mounted on each bracket 136 and engages the cross member 134 to releasably lock the cross member in a desired position. Alternatively, the laser can be slid to the operator side of the machine to allow for angular adjustment or maintenance of the sensor. The sensor 130 monitors the position of the fabric 60 and automatically signals the operator or adjusts the slitting apparatus if the fabric is lifted upwardly towards the slitting member. In a preferred embodiment, the signal from the sensor 130 triggers an upward retraction of the slitting member or a stoppage of the vacuum so as to ensure that the fabric is not damaged by the slitting device. In particular, the pneumatic cylinder is actuated so as to pivot the slitting apparatus upwardly about pin 64 and away from the fabric. A commercially available sensor 130 is the Nippon Automated LAS-8010 laser sensor available from Adsens Tech. Inc.

Also as shown in FIGS. 1 and 2, a support tube 142 or bar is attached to bracket 144 and supports a bottom surface 146 of the fabric immediately behind the housing 12. Preferably, the support tube is rotatably mounted beneath the fabric so as to not wear the fabric. The support tube impinges slightly on the fabric so that the fabric wraps around the tube and thereby further helps to prevent the fabric from being drawn to the slitting device. An adjustment screw 147 threadably engages a flange extending rearwardly from bracket 136 and engages a bottom surface of bracket 144. The screw 147 can be rotated to adjust the vertical position of the support tube, and the relative impingement against the fabric.

Figure 15:
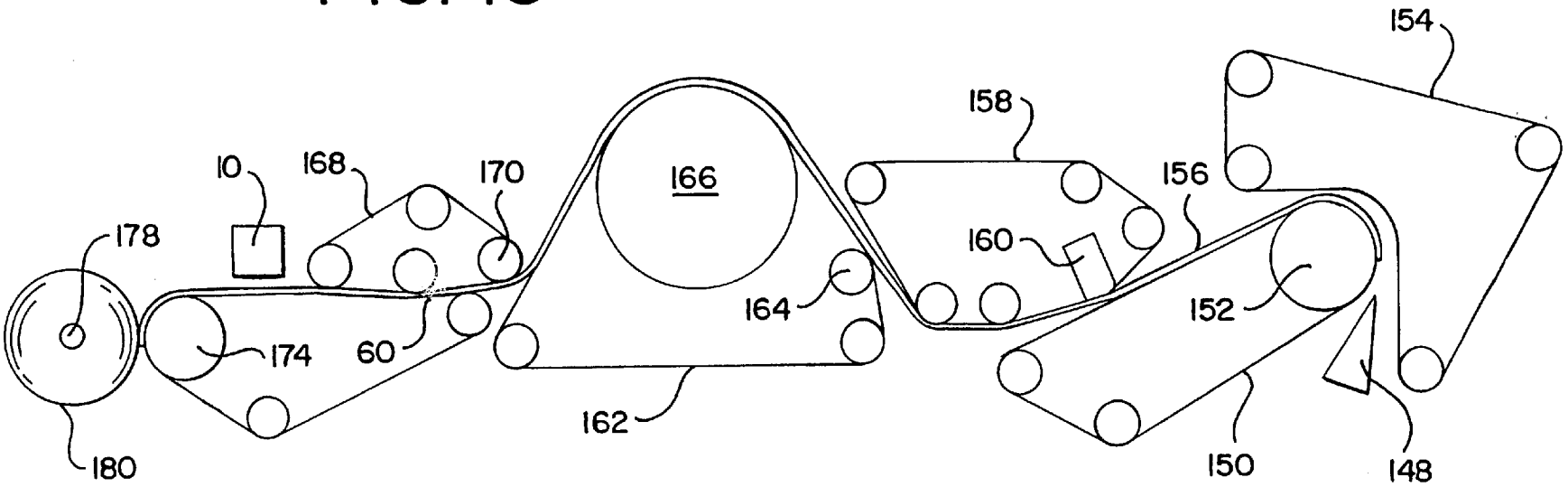
FIG. 15 is a schematic flow diagram of a method for making a sheet material web.

Referring to FIG. 15, a schematic diagram for forming a sheet material web without an open draw is shown. The apparatus and method for making such a web is set forth in U.S. Pat. No. 5,593,545, issued Jan. 14, 1997 and U.S. Pat. No. 5,591,309, issued Jan. 7, 1997, both of which are herein incorporated by reference. However, it should be understood by one of skill in the art that the present invention could be used with other paper forming processes which utilize fabrics and/or belts to carry the sheet material without an open draw, and can be used for slitting other types of sheet materials other than paper products.

As explained in U.S. Pat. Nos. 5,593,545 and 5,591,309, and as shown in FIG. 15, a representative throughdrying process for making uncreped throughdried tissues is shown. Shown is the headbox 148 which deposits an aqueous suspension of papermaking fibers onto inner forming fabric 150 as it traverses the forming roll 152. Outer forming fabric 154 serves to contain the web while it passes over the forming roll and sheds some of the water. The wet web 156 is then transferred from the inner forming fabric to a wet end transfer fabric 158 with the aid of a vacuum transfer shoe 160. This transfer is preferably carried out with the transfer fabric traveling at a slower speed than the forming fabric (rush transfer) to impart stretch into the final sheet material web. The wet web is then transferred to the throughdrying fabric 162 with the assistance of a vacuum transfer roll 164. The throughdrying fabric carries the web over the throughdryer 166, blows hot air through the web to dry it while preserving bulk. There can be more than one throughdryer in series (not shown), depending on the speed and the dryer capacity. The dried tissue sheet is then transferred to a first dry end transfer fabric 168 with the aid of vacuum transfer roll 170. The sheet material web shortly after transfer is sandwiched between the first dry end transfer fabric and the second dry end transfer fabric 60 to positively control the sheet path. Suitable fabrics for use as the first dry end fabric include without limitation, a wide variety of fabrics such as Asten 934, Asten 939, Albany 59M, Albany Duotex DD207, Lindsay 543 and the like. After the sheet material web is compressed between the first dry end transfer fabric and the second dry end transfer fabric 60, which, in one embodiment, has a greater air permeability than that of the first dry end transfer fabric, the web is wrapped around the reel drum 174. Suitable second dry end transfer fabrics include, without limitation, Asten 960 (air permeability of about 300–400), Appleton Mills style Q53F (air permeability of about 400), Appleton Mills style Q53KY (air permeability of about 200). Because of the air flow through the lower fabric caused by roll, the sheet transfers to the second dry end transfer fabric. It is retained on the top surface of the second dry end transfer fabric by air pressure generated by the presence of an air foil on the underside of the fabric. The sheet material web is then carried to the winding nip formed between the reel drum 174 and the reel 178 and wound into a roll 180.

In an alternative embodiment, the permeability of the second transfer fabric 60 is much lower than the corresponding fabric used for the above-described method. By lowering the permeability of the second dry end transfer fabric, the need for an air foil is eliminated because with the lower permeability of the second fabric, the sheet tends to naturally adhere to that fabric. At the point of separation the sheet follows the lower permeability fabric due to vacuum action. No air is pumped through the fabric by the various rolls and no foils are required. Suitable low air permeability fabrics for this embodiment include, without limitation, Asten 960 dryer fabric (air permeability of about 50–100), COFPA Mononap NP 50 dryer felt (air permeability of about 50) and Appleton Mills dryer felt style H53FH (air permeability of about 75).

As shown in FIG. 15, the apparatus 10 is positioned over the second dry end transfer fabric 60 between the first dry end transfer fabric 168 and the reel drum 174. Preferably, the apparatus of FIGS. 1–2 is used in conjunction with the second dry end transfer fabric of the second embodiment described above, which has a low permeability.

In operation, a vacuum is continuously applied through the apertures 118 in the plate member 102 so as to apply a negative pressure to a portion of the sheet material web and thereby lift the web from the fabric 60 and thereafter be drawn into the recess 116 and into contact with the concave surface 104 of the plate member. The slitting member 16, or saw blade, extends through the slot 120 in the plate member and into the recess 116 formed by the plate member. Preferably, slitting member 16 does not extend below the bottom surface 98, 112 of the shoe member or vacuum plate member. Accordingly, as the sheet material is carried by the fabric, a portion of the web is lifted from the fabric 60 and carried past the slitting member which makes a slit in the sheet material web 100, thereby forming separate strips of sheet material web. As the sheet material web strips traverse past the slitting member 16 and beyond the apertures 118 applying the vacuum, the raised portions of the strips settle back onto the fabric 60, or are reapplied thereto, and are thereafter transferred to the wind-up reel 178 and wound into rolls 180.

It should be understood by those of skill in the art that a fixed knife, water jet, laser or like slitting member could be positioned in the housing. Alternatively, the vacuum can be applied to the sheet material web without a housing. Moreover, other penetrating devices, capable of cutting, puncturing and/or perforating the web can also be positioned adjacent the fabric and web and act upon the web as it is separated from the fabric without contacting or otherwise damaging the fabric.

Figure 14:
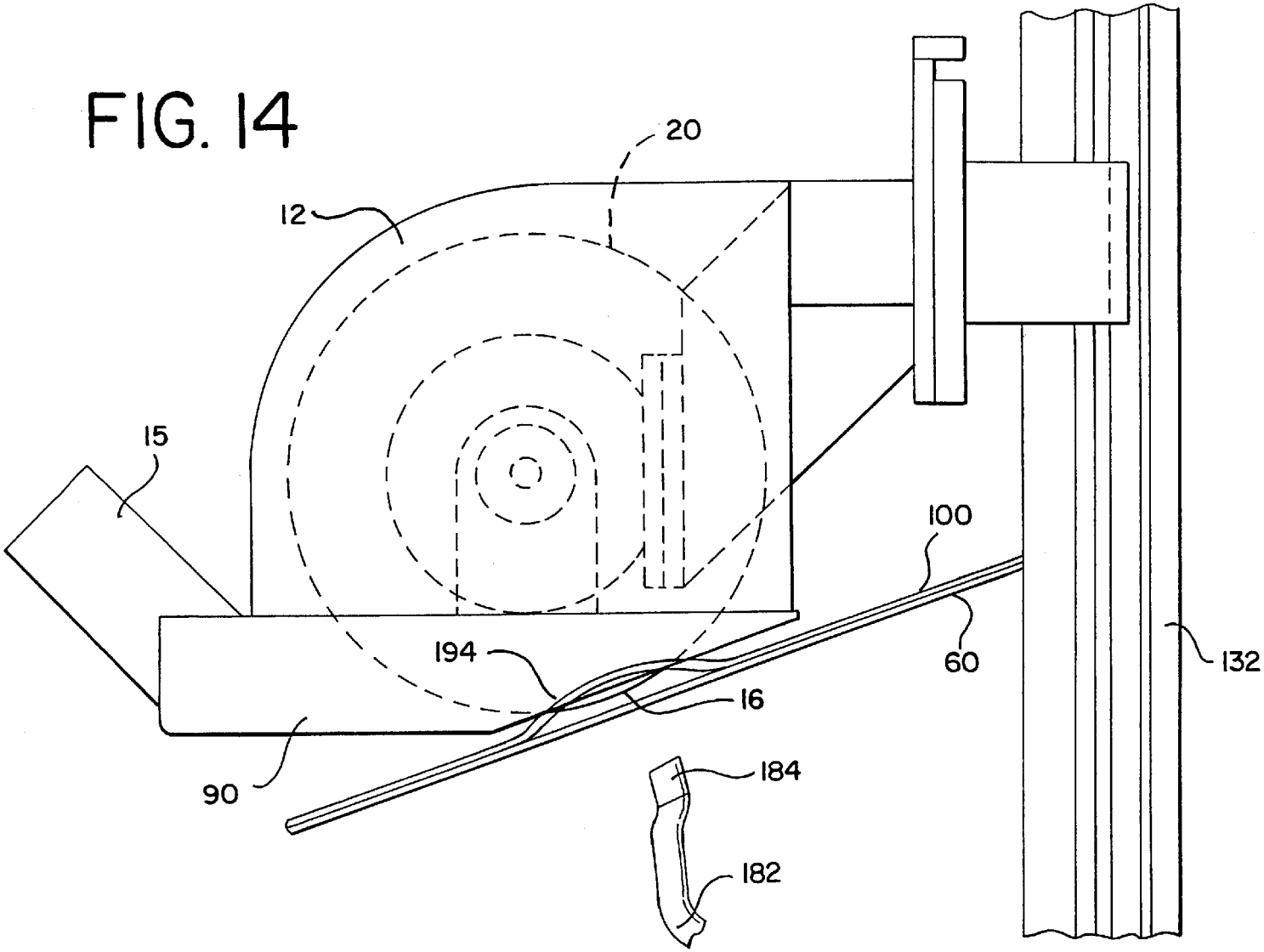
FIG. 14 is an alternative embodiment of the slitting apparatus.

In an alternative embodiment, shown in FIG. 14, the slitting apparatus includes a flexible air line 182 and nozzle 184 positioned beneath the second dry end transfer fabric 60 of the first embodiment described above, i.e., a fabric having a relatively high permeability, and beneath the mouth 194 of the housing and the slitting member 16. In this embodiment, the nozzle 184 continuously emits a stream of pressurized air which passes through the relatively permeable fabric and provides a positive pressure which lifts a portion of the sheet material web off of the fabric and into contact with the slitting member. As with the first embodiment, the raised portions of the strips of sheet material web settle back onto, or are reapplied to, the fabric after being slit.

It should be understood by one of skill in the art that the vacuum and pressurized air can be used either separately, or in conjunction, depending on the thickness of the sheet material web being slit and the permeability of the fabric carrying the sheet material web. For example, when using only a vacuum applied to a relatively impermeable fabric having a basis weight of about 800 to 1100 g/m$^2$, a 4 inch WC to 25 inch WC vacuum is sufficient to lift a portion of the sheet material web having a basis weight of from about 18.6 g/m$^2$ to about 32.0 g/m$^2$ off of the fabric and into contact with the slitting member, but without drawing the fabric into contact with the slitting member.

The slitting apparatus and method of slitting provides significant advantages. First, the invention provides for slitting the web, or similar modification such as by cutting or puncturing, while being supported on a fabric, which allows the manufacturer to do away with open draws. Accordingly, sheet breaks and the like are reduced, while simultaneously allowing for the manufacture of a softer, more desirable sheet material product. In particular, the shoe member and vacuum plate, in conjunction with the sensor, and adjustment screws ensure that the fabric is prevented from being drawn into the slitting device. In addition, the invention eliminates the need for wet slitting which helps to preserve the throughdrying fabric, improves the control of sheet web and provides a more uniform web. Moreover, the lateral position of the slitting apparatus can be easily adjusted and changed.

In addition, the slitting apparatus can be used with a one-piece fabric which extends laterally across substantially the entire cross-machine span of the machine. This avoids the problems of the web being caught between multiple, adjacent fabrics or belts, and the associated problems with keeping such belts properly aligned. Moreover, the slitting operation can be moved laterally along the transverse direction of the web without having to reconfigure the underlying fabrics or belts.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

We claim:

1. An apparatus for penetrating a sheet material web carried on a fabric, said apparatus comprising:

a penetrating device adapted to be positioned adjacent to said fabric in a spaced apart relationship therewith and to penetrate said sheet material web as said fabric carries said sheet material web past said penetrating device;

an air flow adapted to separate a portion of the sheet material web from the fabric adjacent said penetrating device so as to bring said portion of said sheet material web into contact with said penetrating device as said fabric travels past said penetrating device in a spaced apart relationship therewith; and whereby said penetrating device is adapted to penetrate said sheet material web while being carried on said fabric and while said penetrating device remains spaced apart from said fabric so as to avoid contact therewith.

2. The apparatus of claim 1 wherein said penetrating device comprises a slitting member adapted to slit continuously said sheet material web longitudinally along its length as the fabric carries the sheet material web past the slitting member.

3. The apparatus of claim 2 wherein said slitting member comprises a rotary saw blade.

4. The apparatus of claim 1 wherein said air flow comprises a vacuum, and wherein a housing is disposed around said penetrating device, said housing having a mouth adapted to open towards said fabric, and wherein said vacuum is applied to said housing, whereby said vacuum is adapted to separate said portion of said sheet material web from said fabric at said mouth of said housing.

5. The apparatus of claim 4 further comprising a plate covering said mouth, said plate having a plurality of apertures and a slot, wherein said penetrating device comprises a blade extending through said slot in said plate.

6. The apparatus of claim 5 wherein said plate has a downwardly facing concave surface forming a recess, said blade extending through said slot in said plate into said recess.

7. The apparatus of claim 5 wherein said slot extends forwardly from said plurality of apertures in said plate.

8. The apparatus of claim 4 wherein said housing further comprises a shoe member mounted to a bottom of said housing and forming said mouth of said housing, said shoe member comprising a rearwardly extending nose portion adapted to be positioned next to said sheet material web and said fabric.

9. The apparatus of claim 1 wherein said air flow comprises a pressurized air stream, and wherein an air hose emits said pressurized air stream, said air hose adapted to be positioned next to said fabric and to separate said portion of said sheet material web from said fabric adjacent to said penetrating device so as to bring said sheet material web into contact with said penetrating device as said fabric travels past said penetrating slitting device in a spaced apart relationship.

10. The apparatus of claim 1 further comprising a sensor adapted to monitor the position of the fabric adjacent said penetrating device.

11. The apparatus of claim 1 wherein said penetrating device is pivotably and moveably attached to a frame member.

12. The apparatus of claim 1 wherein said penetrating device and said air flow are adapted to be moveable in a lateral direction relative to the longitudinal direction of the sheet material web.

13. An apparatus for penetrating a sheet material web carried on a fabric, said apparatus comprising:

said fabric adapted to carry said sheet material web;

a penetrating device positioned adjacent said fabric in a spaced apart relationship therewith and adapted to penetrate said sheet material web as said fabric carries said sheet material web past said penetration device;

an air flow adapted to separate a portion of the sheet material web from the fabric adjacent said penetrating device so as to bring said portion of said sheet material web into contact with said penetrating device as said fabric travels past said penetrating device; and whereby said penetrating device is adapted to penetrate said sheet material web while said sheet material web is being carried by said fabric and while said penetrating device remains spaced apart from said fabric so as to avoid contact therewith.

14. The apparatus of claim 13 wherein said air flow comprises a vacuum and wherein a housing is disposed around said penetrating device, said housing having a mouth opening towards said fabric and a bottom surface spaced apart from said fabric, and wherein said vacuum is applied to said housing, whereby said portion of said sheet material web is separated from said fabric at said mouth of said housing.

15. The apparatus of claim 14 further comprising a plate covering said mouth, said plate having a plurality of apertures and a slot, and wherein said penetrating device comprises a blade extending through said slot in said plate.

16. The apparatus of claim 15 wherein said plate has a curved surface forming a recess opening towards said fabric, said blade extending through said slot in said plate and into said recess, said blade positioned above said bottom surface of said housing.

17. The apparatus of claim 15 wherein said slot extends forwardly from said plurality of apertures in said plate.

18. The apparatus of claim 14 wherein said housing further comprises a shoe member mounted to a bottom of said housing and forming said mouth of said housing, said shoe member comprising a rearwardly extending nose portion positioned over said fabric.

19. The apparatus of claim 13 wherein said air flow comprises a pressurized air stream and wherein an air hose is positioned adjacent said fabric, said air hose emitting said pressurized air stream so as to separate said portion of said sheet material web from said fabric so as to bring said portion of said sheet material web into contact with said penetrating device above said fabric as said fabric travels past said penetrating device.

20. The apparatus of claim 13 further comprising a sensor adapted to monitor the position of the fabric adjacent said penetrating device.

21. The apparatus of claim 13 wherein said penetrating device is moveably attached to a frame member.

22. The apparatus of claim 13 wherein said penetrating device is laterally moveable relative to said longitudinally moving fabric.

23. The apparatus of claim 22 further comprising a sensor adapted to monitor the position of the fabric adjacent said penetrating device and wherein said sensor is laterally moveable.

24. The apparatus of claim 13 wherein said penetrating device comprises a slitting member adapted to slit said sheet material web longitudinally along its length as said fabric carries said sheet material web past said slitting member.

25. The apparatus of claim 24 wherein said slitting member comprises a blade.

26. The apparatus of claim 25 wherein said blade comprises a rotary blade.

27. An apparatus for penetrating a sheet material web carried on a fabric, said apparatus comprising:

said fabric having a first and second surface, said first surface adapted to carry said sheet material web;

a housing positioned adjacent said first surface of said fabric in a spaced apart relationship therewith, said housing having a mouth opening towards said first surface of said fabric;

a penetrating device disposed in said housing in a spaced apart relationship with said first surface of said fabric;

an air flow directed into said mouth of said housing, said air flow adapted to separate a portion of the sheet material web from the fabric adjacent said penetrating device so as to bring said portion of said sheet material web into contact with said penetrating device as said fabric travels past said penetrating device.

28. The apparatus of claim 27 wherein said housing further comprises a plate covering said mouth of said housing, said plate having an opening wherein said penetrating device extends through said opening in said plate.

29. The apparatus of claim 28 wherein said housing has a bottom spaced apart from said first surface of said fabric, and wherein said plate has a recess formed above said bottom and opening towards said first surface of said fabric, said penetrating device extending through said opening in said plate into said recess.

30. The apparatus of claim 28 wherein said plate further comprises a plurality of apertures for transmitting said air flow.

31. The apparatus of claim 30 wherein at least a portion of said plurality of said apertures are positioned in said plate adjacent along at least a portion of said opening.

32. The apparatus of claim 27 wherein said air flow comprises a vacuum applied through said mouth of said housing.

33. The apparatus of claim 27 wherein said housing with said penetrating device is moveably mounted to a frame member.

34. The apparatus of claim 27 wherein said air flow comprises a pressurized air stream directed toward said mouth of said housing through said fabric from a source positioned adjacent said second surface of said fabric.

35. An apparatus for penetrating a sheet material web carried on a fabric, said apparatus comprising:

said fabric having a first and second surface, said first surface adapted to carry said sheet material web;

a housing positioned adjacent said first surface of said fabric in a spaced apart relationship therewith, said housing having a bottom surface spaced apart from said first surface of said fabric and a recess opening toward said first surface of said fabric, said recess formed in said housing above said bottom surface;

a penetrating device disposed in said housing and extending into said recess in a spaced apart relationship with said first surface of said fabric, said penetrating device positioned above said bottom surface of said housing;

a vacuum applied to said housing, said vacuum adapted to continuously separate a portion of the sheet material web from the fabric adjacent said penetrating device so as to draw said portion of said sheet material web into said recess and into contact with said penetrating device as said fabric travels past said penetrating device.

36. The apparatus of claim 35 wherein said housing further comprises a plate member having a curved surface defining said recess.

37. The apparatus of claim 36 wherein said plate member has at least one aperture through which said vacuum is adapted to be applied to said sheet material web from said housing.

* * * * *

UNITED STATES PATENT AND TRADEMARK OFFICE

CERTIFICATE OF CORRECTION

PATENT NO. : 5,988,030
DATED : November 23, 1999
INVENTOR(S) : Frank S. Hada et al.

It is certified that error appears in the above-identified patent and that said Letters Patent is hereby corrected as shown below:

Column 1,
After line 3, under "U.S. PATENT DOCUMENTS", insert:

| | | | |
|---|---|---|---|
| -- 4,113,557 | 9/1978 | Kankaanpaa | 162/307 --. |

After line 6, under "U.S. PATENT DOCUMENTS", insert:

| | | | |
|---|---|---|---|
| -- 4,663,100 | 5/1987 | Mioche | 83/176 X |
| 4,815,220, | 3/1989 | Wedel | 34/120 --. |

Column 2,
After line 2, insert:

-- FOREIGN PATENT DOCUMENTS

| | | | |
|---|---|---|---|
| 158,998 | 2/1983 | Germany | 83/176 --. |

Line 7, delete "Leone" and substitute -- Lione -- in its place.

Claim 13,
Line 7, delete "penetration" and substitute -- penetrating -- in its place.

Signed and Sealed this

First Day of January, 2002

*Attest:*

*Attesting Officer*

JAMES E. ROGAN
*Director of the United States Patent and Trademark Office*